US008474536B1

(12) United States Patent
Tseytlin et al.

(10) Patent No.: US 8,474,536 B1
(45) Date of Patent: Jul. 2, 2013

(54) METHOD AND ALIGNMENT SYSTEM FOR KILLING AN UNCONTROLLED OIL-GAS FOUNTAIN AT AN OFFSHORE OIL PLATFORM USING A TELESCOPIC ROD ASSEMBLY

(71) Applicants: Simon Tseytlin, Middle Village, NY (US); Alexey S. Kashik, Moscow (RU)

(72) Inventors: Simon Tseytlin, Middle Village, NY (US); Alexey S. Kashik, Moscow (RU)

( * ) Notice: Subject to any disclaimer, the term of this patent is extended or adjusted under 35 U.S.C. 154(b) by 0 days.

(21) Appl. No.: 13/675,915

(22) Filed: Nov. 13, 2012

Related U.S. Application Data

(60) Provisional application No. 61/681,257, filed on Aug. 9, 2012.

(51) Int. Cl.
*E21B 7/12* (2006.01)

(52) U.S. Cl.
USPC ..... 166/335; 166/339; 166/345; 166/363; 166/364

(58) Field of Classification Search
USPC ..... 166/363, 339, 364, 368, 285, 381, 166/386, 387, 75.15, 179, 192, 193; 138/89
See application file for complete search history.

(56) References Cited

U.S. PATENT DOCUMENTS

| | | | | |
|---|---|---|---|---|
| 8,205,677 | B1 * | 6/2012 | Salkin | 166/363 |
| 2012/0018174 | A1 * | 1/2012 | Kotefski et al. | 166/386 |
| 2012/0217020 | A1 * | 8/2012 | Edwards et al. | 166/363 |
| 2012/0273213 | A1 * | 11/2012 | Blalock et al. | 166/341 |
| 2012/0305260 | A1 * | 12/2012 | Paturu | 166/352 |

* cited by examiner

*Primary Examiner* — Matthew Buck
*Assistant Examiner* — James Sayre
(74) *Attorney, Agent, or Firm* — Boris Leschinsky

(57) ABSTRACT

A method and an apparatus for killing of uncontrolled oil fountain include a series of rods with the first rod having the smallest diameter and successive rods having increasing diameters. Such telescopic assembly of rods is lowered into the well to cause gradual reduction in cross-sectional area available for oil flow discharge. Once sufficiently large rods are lowered into the well, the oil fountain discharge will be greatly diminished. Final sealing may be accomplished by pumping cement into a space formed between the well pipe and the rod assembly. A novel system for aligning the rods to the center of the well is also described.

4 Claims, 7 Drawing Sheets

METHOD AND ALIGNMENT SYSTEM FOR KILLING AN UNCONTROLLED OIL-GAS FOUNTAIN AT AN OFFSHORE OIL PLATFORM USING A TELESCOPIC ROD ASSEMBLY

CROSS-REFERENCE DATA

This application claims the priority date benefit from a U.S. Provisional Application No. 61/681,257 filed 9 Aug. 2012 and entitled "The Method of Killing an Uncontrolled Oil-Gas Fountain at an Offshore Oil Platform Using a Telescopic Rod Assembly". This provisional application is incorporated herein in its entirety by reference.

BACKGROUND

The present invention relates to a method and system for the extinction or "killing" of an offshore oil well after an explosion or a blowout causing an uncontrolled fountain of oil fluids mixed with gas from the remaining part of the well. The term "oil well" is used herein to describe a well that produces any type of hydrocarbons including oil and gas, but which may also produce a gas condensate or water as part of the multi-fluid mixture discharge that comes out of the well. The present invention more specifically relates to methods for controlling the fluid discharge by gradually decreasing fluid flow using a telescopic assembly of flow restricting rods.

In the field of offshore oil drilling, the oil wells are kept under control by means of a column of mud which provides a hydrostatic load sufficient for maintaining overpressure between the well and the external pressure at controlled values. This column of mud, also known as primary well control barrier, is present both inside the well and also in a pipe called a riser which connects the drilling platform to the sea bottom.

At the sea bottom, moreover, in correspondence with the well heads, there are present secondary well control devices, called blowout preventers (BOP) configured as valves to close the well in the case of uncontrolled discharges of fluids from the well itself.

Often during drilling or well exploration in gas and oil wells, a gas kick may enter into the well space. Such gas may come from the well reservoir and reach the bottom hole of the well. If this is not detected immediately, a gas bubble (gas kick) is created in the hole. Gas kick, according to Archimedes' principle begins to ascend within the annular space of the well. If not allowed to expand, such gas kick brings its initial high pressure equal to the formation pressure to the head of the well. At the same time, the pressure everywhere along the well begins to rise. If the BOP is closed, and there is no "washing" in the well, a hydrofracture of formation may occur. As a result, the drilling fluid enters the formation, and the well is filled with gas. If the drill pipe has no check valve, the gas also fills drill pipes all the way up to the wellhead. This may cause a gas explosion that may result in human casualties, environmental pollution and the creation of an uncontrolled fountain. This uncontrolled fountain is very difficult to suppress, because the wellhead is under enormous pressure. As offshore drilling on the continental shelves is progressing into deeper and deeper waters, the problem is many times more complicated when the explosion occurs in deep waters. Suppressing such a well and cleaning of the environment may cost billions of dollars.

Presently known are various techniques for reestablishing the control of the well in case of a blowout, such as for example the techniques of bridging, capping, production of a relief well and assembling a string of pipes for the injecting cement down the well, such string is sometimes referred to as a killing string.

A killing intervention consists of the insertion of a specific string of pipes inside a blowout well. When inserted in the well, the killing string allows conventional killing techniques to be applied such as the circulation of heavy mud, closure by means of inflatable packers, and so forth. This method has proved to be the most rapid, but it can currently only be used in the case of well blowouts in shallow water, i.e. less than 1,000 meters deep. In addition, in order to allow for the adequate flow of cement through the killing string, its internal diameter has to be sufficiently large such as at least 10 cm or more. Inserting such a large string of pipes presents a challenge due to an enormous pressure in the well urging the killing string out of the well. Additional methods of killing a well include drilling a side channel into the well and sealing the well through such channel. This method takes a long time of several months and is also quite expensive. In addition, there is always an uncertainty present as to the exact location of the well deep down under the floor of the sea. On occasion, if the side channel has missed the well, a powerful explosion may have to be used to shift the layers of the rocks and the ground near the well so as to seal it properly. Underground nuclear explosions are known to be used for such purpose.

To date, no practical equipment or method is available to the industry for the purpose of regaining control of a deep water abandoned wellhead on the offshore seabed after a blowout causing spilling of reservoir fluids into the sea. The environmental pollution caused by such outpouring of reservoir fluids and gases can have disastrous consequences, as evident by the 2011 pollution created over a large section of the Gulf of Mexico and adjacent beaches by the erupted BP well off the coast of Mexico.

There is a need for an improved method for killing of an uncontrolled fountain from an oil well following a blowout event.

SUMMARY OF THE INVENTION

The object of the present invention is to provide an improved method of killing an uncontrolled oil or gas fountain emanating from a damaged underwater oil well.

The novel method of the invention includes steps of lowering down a series of rods starting with the rod having the smallest diameter. Small diameter rod may be inserted into the well with less difficulty as compared with larger diameter rods. Once the smallest rod is in place, the cross-sectional area of the well available for oil flow discharge is somewhat reduced. Larger diameter rods may then be inserted in a successive series following the first rod. Gradually, most or even the entire cross-section of the well pipe is occupied by the telescopic assembly formed from these rods. Once these flow-restricting rods are in place, the well may be sealed by pumping in cement within the remaining space between the well and the rod assembly.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

FIG. 4*b* only shows the outline of the lower part of the alignment system.

DETAILED DESCRIPTION OF THE PREFERRED EMBODIMENT OF THE INVENTION

Figure 1:
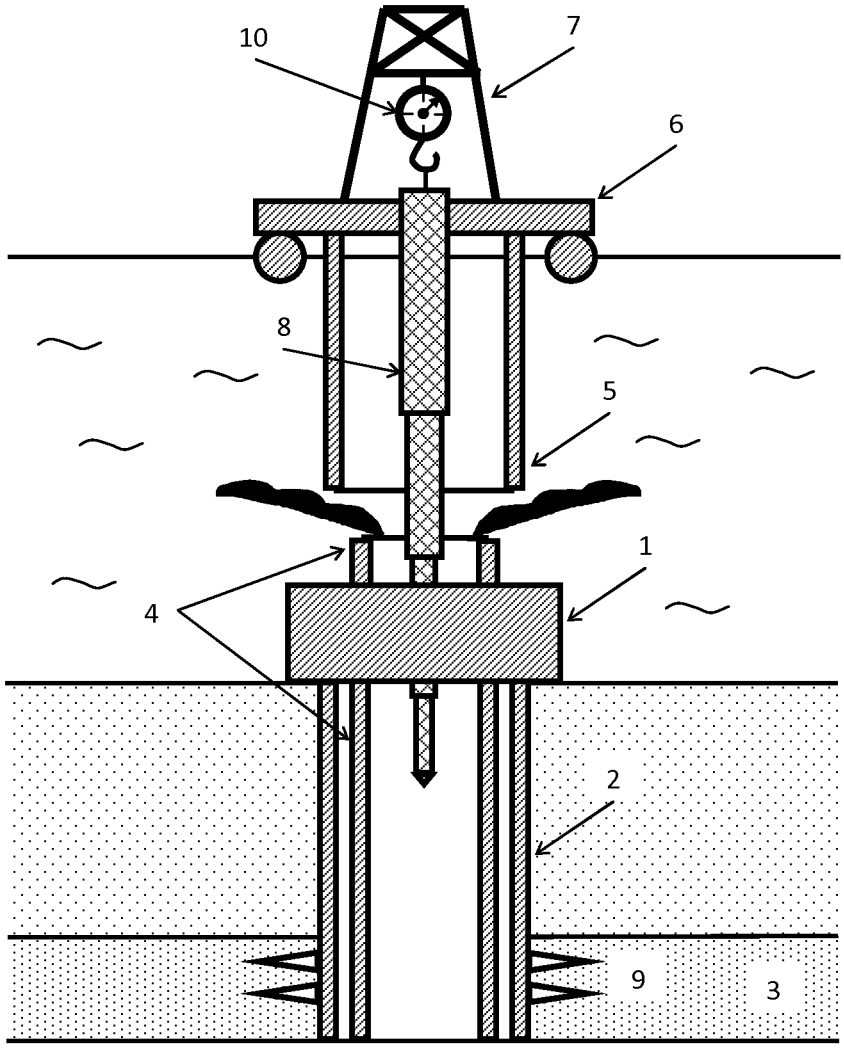
FIG. 1 is a diagram of the smart point system of the invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

The method of the invention works in both cases: when the BOP remains on the well as well as when BOP is missing and only a small section of pipe remains in place. In this case, to prepare the pipe for the method of the invention, its top portion is cut normal to the axis of the pipe leaving a short pipe section extending from the bottom of the ocean.

The method includes successive placement of flow-restricting telescopic rods of increasing diameter down the well in order to gradually reduce the fluid discharge flow. These rods are connected to each other forming together a telescopic system. The rods may be round and have gradually increasing diameters as described below. In embodiments, an exemplary rod is made of metal and has threaded ends adapted for attachment to other rods. The diameter of each rod may be from about 15 mm to about 500 mm. Non-round initial rods may also be used. Importantly, the final diameter of the rod should match as closely as possible the inner diameter of the well pipe. If large diameters are required, materials other than steel may be used for large diameter rods to reduce its weight. Alternatively, such large diameter rods may be made of pipes with inside opening diameter selected appropriately to reduce the weight as needed.

Initial rod is selected to have a small enough diameter so as to enter the opening of a well without much resistance. Considering that the weight of such rod may reach several hundred kilograms since the depth of a well is significant, little or no resistance should be encountered upon entrance of the first rod into the well. Note that the entrance of the tip of the first rod may be aided by centering thereof using known means.

Once the first rod is placed in the well, additional sections of rods of gradually increasing diameters are attached successively to the first rod and lowered one by one into the well. As the total weight of the telescopic rod assembly is increasing, adding more rods should be accomplished without encountering much resistance. Steel rods are quite heavy as compared with water—their density is about ten times greater than that of water. As the diameter of the rods goes up, the cross-sectional area of the well available for fluid discharge goes down and the discharge flow is gradually reduced. This is a result of both the reduction of area available for fluid discharge as well as an increase of friction between the discharge from and the inside surface of the well plus the outer surface of the entire rod assembly. Step-wise transitions between the rods create local Eddie currents and further increase resistance to flow of the discharge fluid from the well. Furthermore, an increased weight of the fluid in the annular space between the well and the rod assembly causes further reduction in fluid discharge.

It is important to properly monitor lowering of successive rods down the well. To illustrate the calculations that will be made for such monitoring, there is provided an example based on the 2011 blowout of a BP oil well in the Gulf of Mexico at the sea depth of 1,000 meters and the well depth of about 3,000 meters with reservoir formation pressure of about 500 atmospheres.

Assuming the diameter of the first rod of about 2.5 cm (about 1 inch), the weight of the first rod at the point of well entrance at the depth of 1000 meters would be about 4,569.5 kg. The counteracting force from the oil fountain will always be less than the reservoir pressure multiplied by the cross-sectional area of the rod (about 2,285 kg). Once the rod is in the well, additional drag force will be acting on it to push it up but even in this case, the weight of the rod easily exceeds all these counteracting forces.

The second 1,000 meter long rod may be selected to be 3 inches in diameter. It is easy to demonstrate that the balance of forces will still be favorable for insertion of the second rod on top of the first rod into the well. The third section may then be selected to be 4 inches in diameter and the final section is 5 inches in diameter. At this point, the weight of the rods will reach about 200,000 kg while the force pushing the rods out of the well is about 58,000 kg—meaning that the system can be further lowered down into the well. Once it is in place, the flow discharge from a 6-inch well would be greatly diminished to allow for the final sealing process to kill the well entirely.

Figure 2:
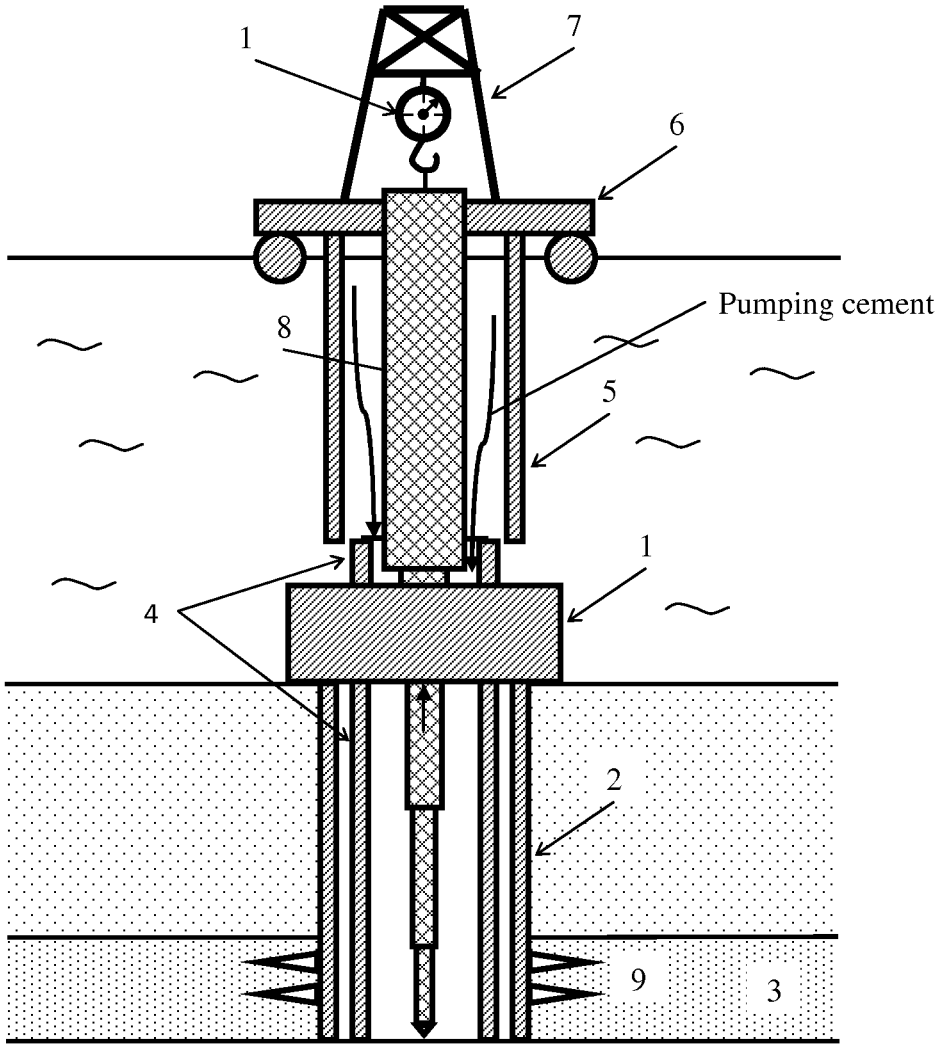
FIG. 2 is a diagram of the flow of points within the smart point system.

This final process includes using a riser having an inside diameter generally equal or just slightly more than the outer diameter of the well pipe. The end of the riser is set on the well (see FIG. 2). In embodiments, the inner edge of the end of the riser may be tapered so as to assure a close fit and alignment of the riser and the well. In embodiments, once the riser is set onto the well pipe, various sealing steps may be undertaken such that the possibility of oil leak out of the well and outside the riser are greatly reduced or even prevented. One such example of a sealing step between the riser and the well pipe is a welding process to permanently attach the riser to the well. Another example is a threaded connection of the riser or a nut about the riser to the well pipe. Other such sealing steps would be readily apparent to those skilled in the art.

Once the riser is set about the well pipe, a standard process of pumping cement down the opening between the riser and the rods is used to seal the well and stop any further oil flow therefrom. Cement may be pumped in sufficient quantity so as to reach the reservoir perforations—once the cement is set, the well is entirely sealed. The riser and remaining rods may be cut off from the well pipe leaving it permanently sealed in place.

An alternative method of monitoring the conditions of lowering the rods into the well may utilize a weight measuring device mounted at the surface platform. Such devices are used routinely during lowering of any rods or pipes down the well. In the case of killing the oil fountain based on the methods of the present invention, such device will show the difference between the weight of the rod assembly (pushing the entire assembly down) and the combination of various forces acting to push it up, including the reservoir pressure and the drag force from the flow of oil or a multiphase flow of various gases and fluids coming out from the well. Such simple method of assessing the conditions of lowering the rod assembly down and adjusting the size and weight of the successive rods allows to eliminate great uncertainties associated with calculating various forces acting on the rods. These uncertainties are not easily accounted for and include variations in discharge of gases and various fluids from the well.

At the beginning, upon the entrance of the rod into the well, the force shown by the weight measurement device will start to decrease as the rod is moved down the well. Additional weight is needed once the weight has dropped to less than about 100 kg or so—which can be provided by using rods of larger diameter for the next section. That diameter may be maintained for some time until the balance is again approaching the lower safe limit of 100 kg. In that case, larger yet rods may be used to cause the balance to increase again. Larger rods will ultimately slow down the fluid discharge from the well. Final rod diameter may be selected to be as close to the well diameter as possible, but preferably not smaller than well diameter by more than 5-10%. Importantly, the weight of the rods should be selected to assure that the weight measuring device shows a positive balance on its scale. This means that the rods are heavier than the forces directed at pushing them out of the well pipe and so continuous lowering of the rods may proceed further.

In embodiments, the safe limit of excess weight on the scale may be selected to be between 100 and 500 kg, or can be assessed as a percentage of the weight of entire rod assembly, such as 5-10% of such weight.

Advantageously, the rods which are used for the purposed of a reciprocating rod pump may be used for this invention. They are already commercially available in a broad range of sizes and can be easily adapted to be used as described above. Using rod pumps is further advantageous because of the available hardware that can be used to connect sections of such rods to each other.

In embodiments, the rod may be made solid and entirely from metal with no voids or passages therein. The end of the rod may be made tapered to facilitate insertion and advancement down the well. In other embodiments, each rod may be brought to the well location on a spool and unfolded during the insertion procedure.

FIG. 1 illustrates the beginning of the process of killing of uncontrolled fountain from an oil well, showing a blowout preventer 1, a well casing 2, formation 3, drilling tubes 4, a riser tube 5, offshore platform 6, a rig 7, a rod (flow restrictor insert) 8, perforations 9, and a weight measurement device 10.

The method of the invention includes the following necessary and optional steps:

1. Provide a plurality of flow restricting rods 8 of various diameters using either a standard floating rig 7 or a ship located near an offshore platform 6;
2. Position a riser tube 5 over the drilling tube 4. Riser tube 5 may have an inner diameter slightly larger than the external diameter of the drilling tube 4. As a result, the lower end of the riser tube 5 may be placed over the head of the well at a distance of about several meters. Alignment and fixation of this riser tube 5 may be accomplished for example using a four-cable brace attached to the outer surface of the head of the well (see FIG. 1);
3. Place a first flow restricting rod 8 into the riser tube 5. To accomplish this, the first section of the rod 8 with the length which may be about equal or less than the height of the drilling rig, may be lowered using the usual method of lowering tubes. The second section of the rod 8 may then be attached to the end of the first section (such as using a threaded attachment), which may then be lowered into the riser tube 5. The process of lowering rods 8 and attaching new sections thereto may be repeated until the lower end of the first rod 8 appears suspended from the bottom of the riser tube 5. To assure entering the drilling tube 4, the first rod 8 may in some embodiments have a smaller diameter or a tapered end;
4. Place the lower end of the first rod 8 into the drilling tube 4 at the well opening. To enter the well, it is critically important to keep the weight of the rod 8 exceeding the force pushing it out of the well by at least a small safety margin, for example 100 kg. Due to its small cross-sectional area and significant weight (which could reach several hundred kilograms), the metal rod 8 can be typically placed inside the drilling tube 4 of the well without much difficulty. If however, such entrance cannot be achieved, the weight of the assembly may be increased by replacing at least some of the upper sections of the assembly with rods of greater diameter—note that rod length, diameter and density (choice of material) represent variables which can be adjusted for each specific circumstance;
5. Following the entrance into the well of the first (lower) portion of the rod assembly having the smallest diameter, the next larger diameter of the rod typically may start at the height of a few hundred meters above that first portion. The exact location of the point in the rod assembly where there is an increase in rod diameter is selected depending on the specific circumstances of each well using the general principle that the weight of the entire assembly should exceed the forces pushing the assembly out of the well. As the first portion of the telescopic rod assembly enters the well, the flow of fluid from the well is reduced because of reduction in available cross-sectional area and because of a new drag resistance of fluid flow around the rods;
6. Additional rods with further increase in diameter are then placed into the well until either the first rod reaches the bottom of the well or until the diameter of the rod matches that of the well so that the fluid flow is gradually reduced to a minimal value—see FIG. 2. In rare circumstances where the diameter of the well and the reservoir pressure are high and the depth of the well is low, the method of the invention teaches using rods with higher density and weight than steel, such as for example copper or wolfram;
7. In embodiments, the lower end of the second rod 8 may be slidingly attached to the body of the first rod (using a ring for example—not shown) so as to assure it will find its way into the well opening and the drilling tube 4. This process may be continued until the wellhead pressure and flow rate of fluid decreases to sufficiently safe levels, so that the well can be easily closed (killed) using standard methods of applying cement;

8. To accomplish a permanent closure of the well, the hanging riser tube 5 may be lowered so that the upper section of drilling tube 4 joins the bottom of the riser tube 5 Additional resistance of the suspended riser tube 5 connecting the wellhead to the drilling rig 7 further reduces the flow rate and wellhead pressure at the sea surface. Cementing the well may now be accomplished. Mortar cement may be fed through the wellhead, which may be pushed into the well until the cement reaches the bottom hole, comes into the annular space of the well and covers the perforated section 9 of the casing from which the oil is coming out. After cement hardens, the flow from the well ceases completely;

9. The riser tube 5 may be then separated (cut off) from the well. In embodiments, at least some of cement may seep through the gap between the top hanging riser tube 5 and the drilling tube 4, thus making their connection hermetic.

To accomplish the method of the invention, there is provided a system for killing of the uncontrolled fountain from an offshore well. The system included a plurality of narrow flow restricting rods, in which each insert may be made solid and sized to have diameter between 15 mm and 500 mm. The system further includes a rig and a riser tubing configured to accept sections or spools of such rods therein and adapted to lower the rods forming a telescopic assembly down the opening of an offshore well.

Description of the Alignment System of the Invention

Proper alignment of telescopic rods with the well pipe is critical for performing the method of killing the fountain according to the present invention. This is especially important for lowering the first rod into the well. In addition to traditional methods and devices used for alignment of pipes and risers over discharging well pipes, the present invention provides for a novel passive mechanical alignment device which can be used to automatically align the riser to the well pipe (with or without the blowout preventer).

Figure 3:
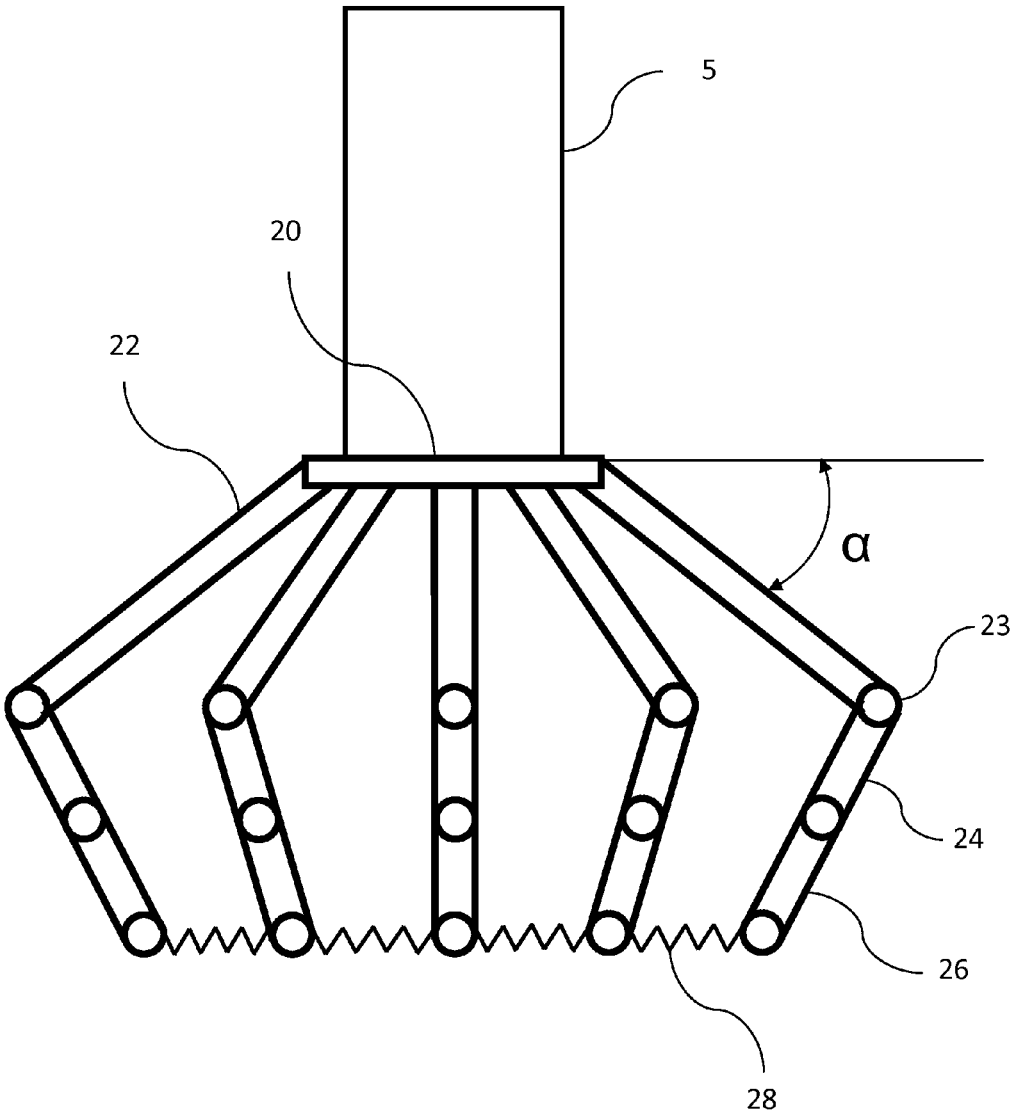
FIG. 3 shows an alignment system of the present invention.

The alignment device is generally shown in FIG. 3. It includes a ring 20 releasably positioned at the lower end of the riser tube 5. In embodiments, the ring 20 may slide up the riser 5 upon release of temporary attachments such as screws or severable connectors. In other embodiments, the riser 5 is equipped with a holding flange on its bottom (not shown) which retains the ring 20 and the entire alignment system at the lower end of the riser 5 while allowing it to slide upwards along the riser tube 5.

Ring 20 is rigidly connected to a plurality or radial arms 22, for example 8 arms as shown in FIG. 3. There may be between 3 and 20 arms attached to the ring. They may be evenly spaced along the periphery of the ring 20. Each radial arm 22 is attached to the ring 20 at the angle $\alpha$ as shown in FIG. 3. The length of each arm 22 and angle $\alpha$ are selected such that the product of multiplication of the length and sin $\alpha$ exceeds the height of the remaining portion of the pipe 4 including the blowout preventer 1 by about 10-20 m. Typically, such length of arms 22 may be selected to be about 30 m.

Joints 23 are placed at the ends of each arm 22 and in turn are connected to additional arms 24 and 26. Each arm assembly therefore includes one rigid arm 22 attached to the ring 20 and one or more articulating arms 24 and 26 attached to the rigid arm 22 via joints 23. The lower ends of each arm assembly are connected to adjacent ends by flexible ties 28 (for example metal springs) such that cumulatively they form a circle, see FIG. 4*b*.

Figure 4A:
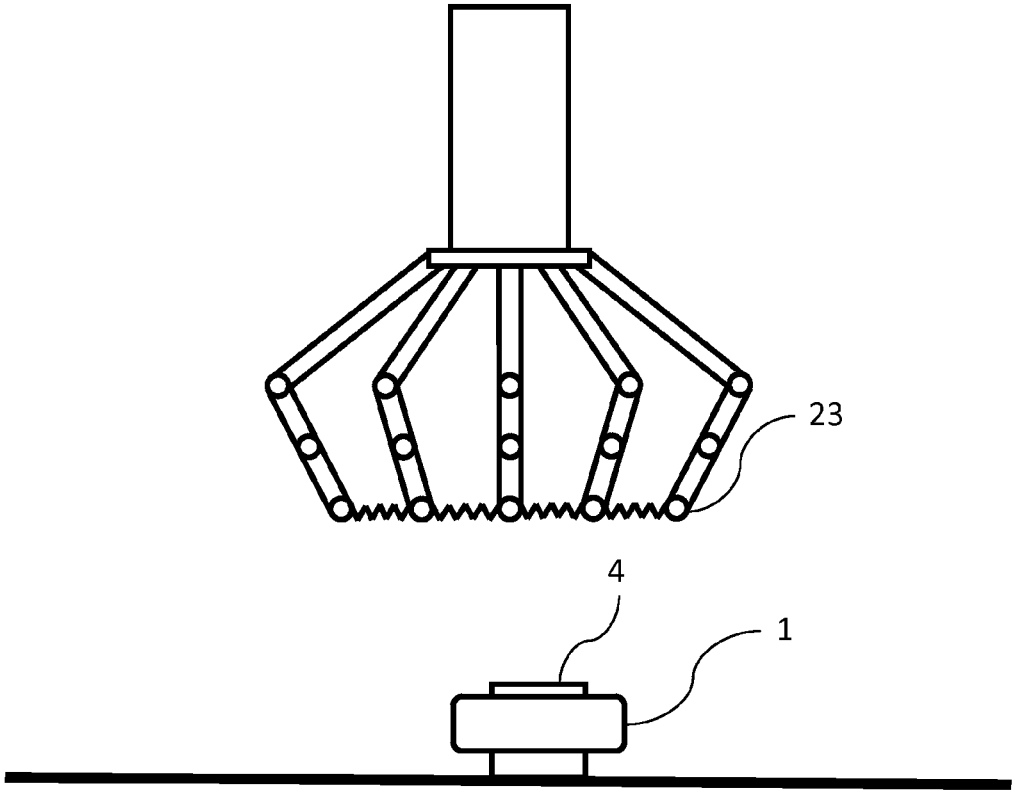
FIGS. 4*a* and 4*b* show the position of the alignment system next to the remaining well as a side view and as a top view.
Figure 4B:
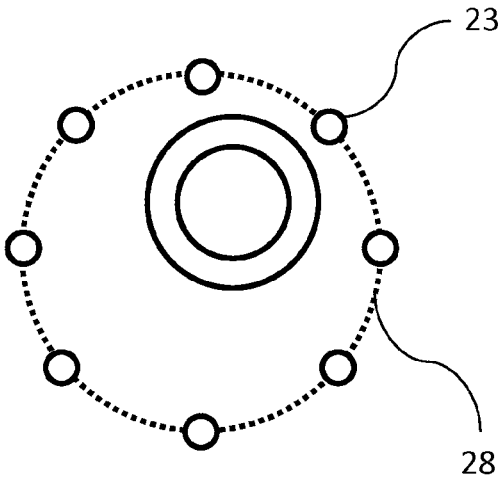
Figure 5A:
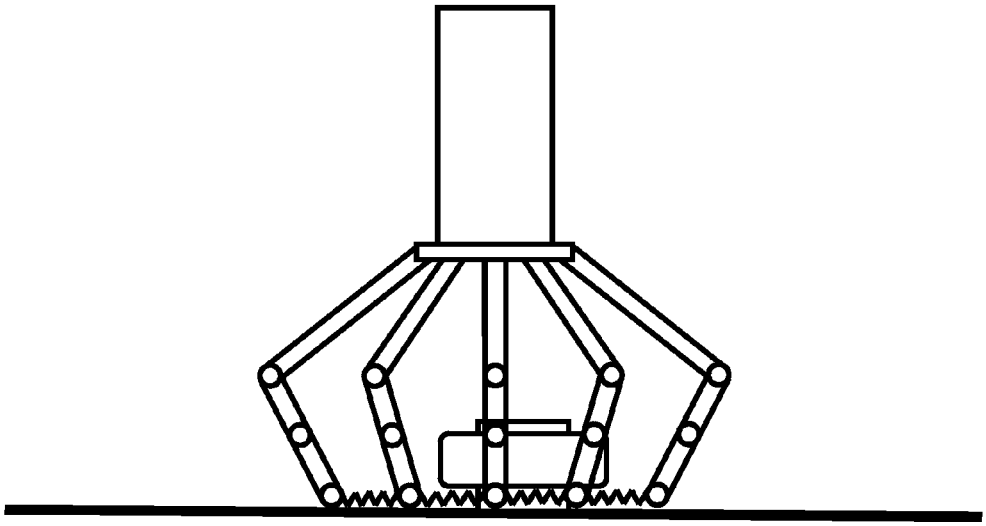
FIGS. 5*a* through 5*d* show various stages of lowering the riser onto the well and operational positions of the alignment system of the invention.
Figure 5B:
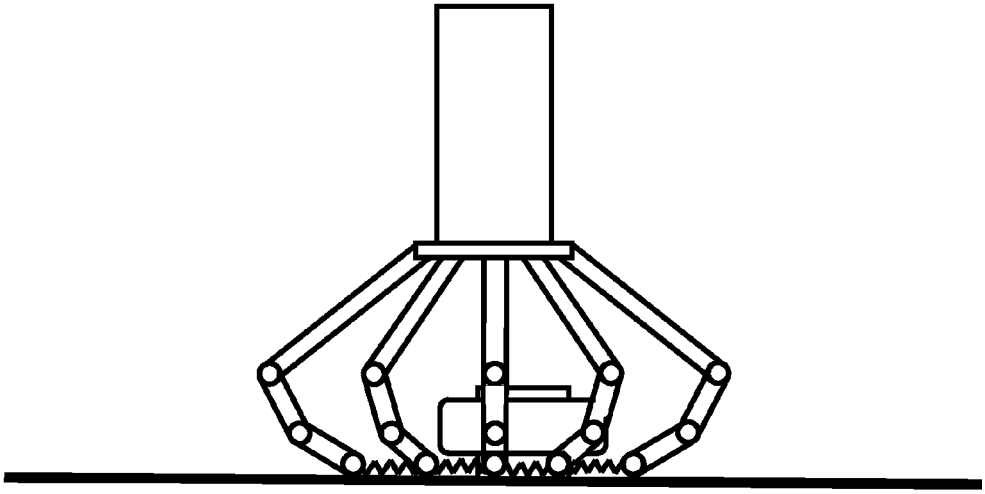
Figure 5C:
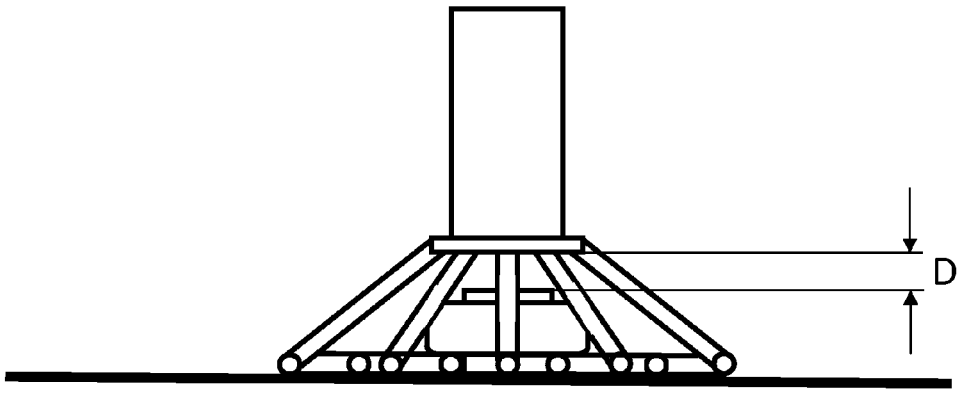
Figure 5D:
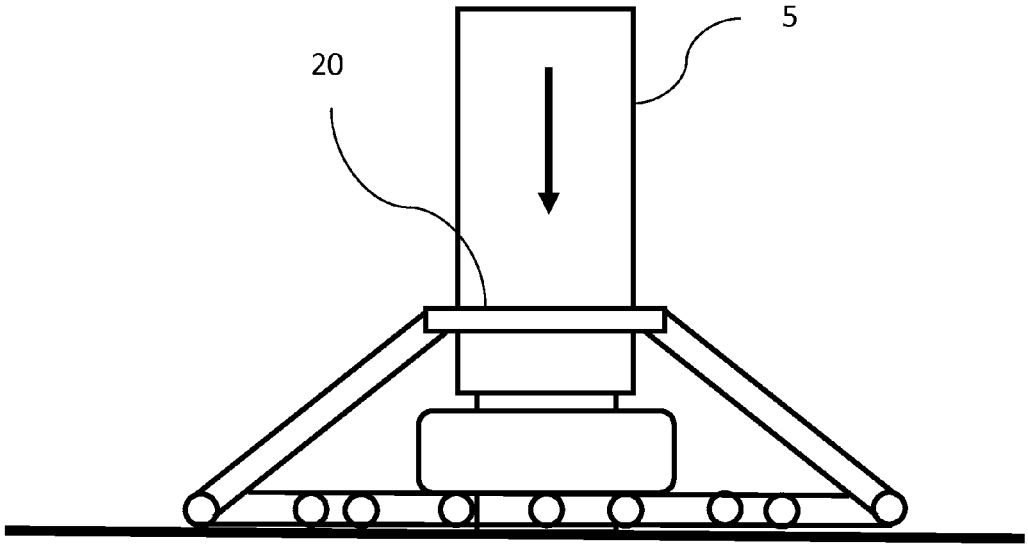

Upon lowering the alignment system placed at the end of the riser towards the well, the initial circle of ties 28 is expanded and may cover an area of several dozen square meters—see FIG. 4*a*. This is needed to cover the well and a possible blowout preventer that may sit on top thereof. Once the location of the well inside the circle of ties 28 is confirmed, the riser is further brought down such that the lower articulating arms 24 and 26 reach the floor of the ocean and start to lay flat thereon—see FIGS. 5*b* and 5*c*. as the ends of the arms 26 move towards the axial center of the riser, first one and then several of them are reaching the well whereby aligning the well with the riser. Importantly, once the riser is aligned with the well, it may be disconnected from the ring 20 and further lowered towards the well. The end of the riser may be kept above the well at a distance D of about 10-30 m such that the discharging oil flow has an opening to continue escaping from the well.

Once the alignment is complete, the telescopic rod assembly may be lowered into the well as described above to gradually reduce the oil discharge from the well.

Figure 6:
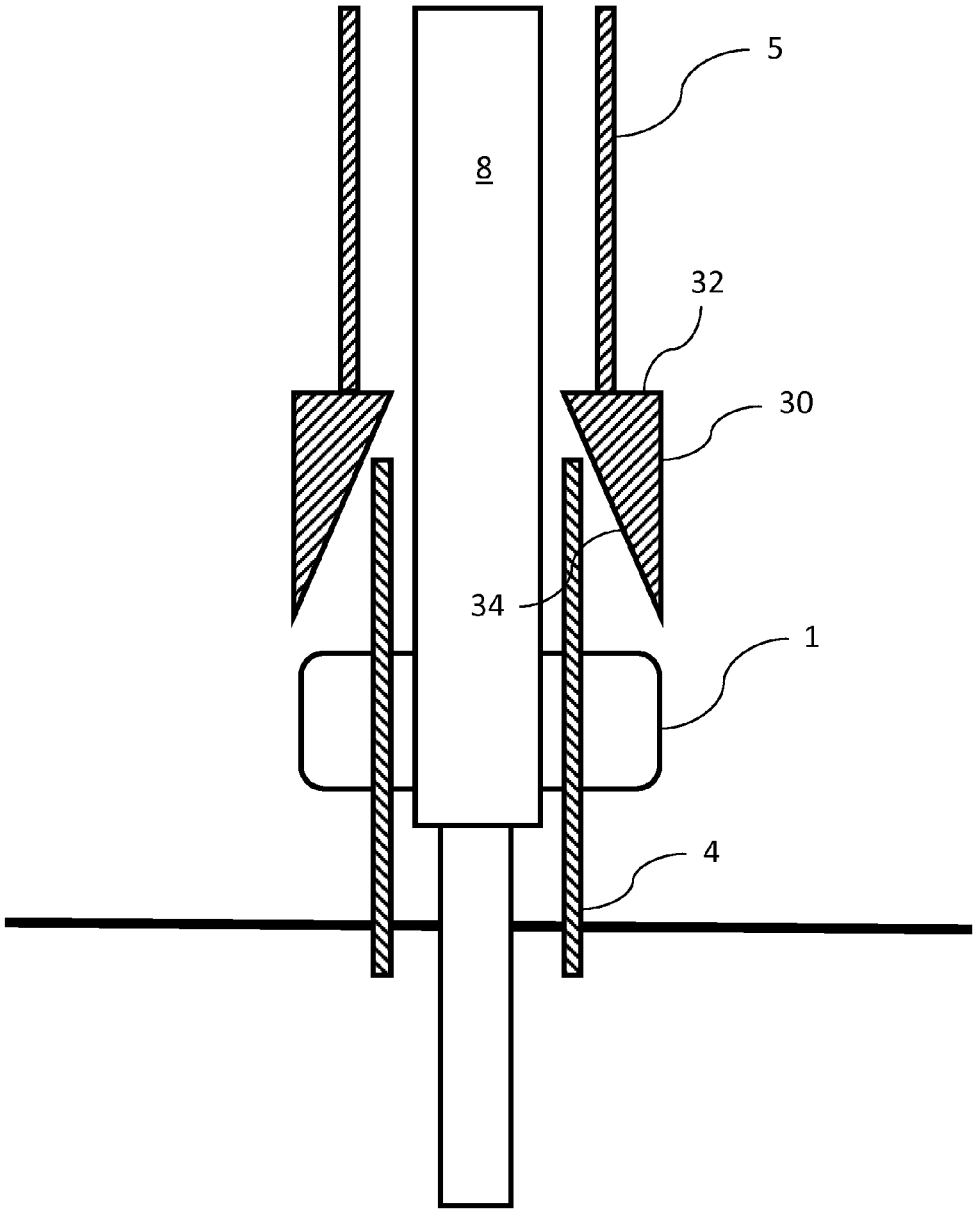
FIG. 6 shows the details of a tapered cap placed at the lower end of the riser to assist in sealing the riser against the well pipe.

FIG. 6 shows further details on one of the embodiments of the present invention in which a tapered cap 30 is attached at the lower end of the riser 5. The tapered surface 34 is arranged to cover the end of the well pipe 4 and further support proper alignment of the telescopic rod assembly 8 inside the well. The outer ledge 32 of the tapered cap 30 may be used as a rest for the ring 20 of the alignment system as described above. Once the tapered cap 30 and the riser 5 are lowered onto the drilling tube 4, they may be permanently attached together for example by welding.

The present invention is aimed at making killing of the well safe, fast and inexpensive so as to prevent heavy environmental and financial losses typically associated with dealing with offshore well blowouts.

In embodiments, the method of the invention may also be used to reduce fluid discharge from the oil well located on land. In that case, the appropriate rod assembly may be first assembled on the ground and then lifted in the air using a helicopter. The helicopter may then deliver the rod assembly to the vicinity of the well and slowly lower it down the well as described above. The weight of the helicopter itself may be used to push the rods down the well if appropriate. To insert additional sections of the rod assembly into the well, the helicopter may either release the first section and allow it to drop down the well, or attach the next section to the previous section by retaining the previous section over the well with the assistance of large construction cranes.

The herein described subject matter sometimes illustrates different components or elements contained within, or connected with, different other components or elements. It is to be understood that such depicted architectures are merely examples, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for killing of an uncontrolled fountain from an offshore oil well comprising the steps of:

a. providing a flow-restricting telescopic rod assembly in a riser tube, said rod assembly comprising individual flow-restricting rods of increasing diameters with a first lower rod being the smallest, said riser tube comprising a lower riser end configured for alignment of the first rod with said well, said lower end of said riser tube is also configured for subsequent sealing connection to said well, b. lowering the first flow-restricting rod into said well through said riser tube so as to reduce a cross-sectional area of said well leading to a reduction of fluid discharge in said uncontrolled fountain, c. attaching additional rods in series to said first rod whereby forming said telescopic rod assembly and lowering thereof into said well, whereby further reducing the cross-sectional area of said well causing a further reduction of fluid discharge in said uncontrolled fountain, d. connecting said lower end of said riser tube to said well once said fluid discharge in said uncontrolled fountain is sufficiently diminished due to presence of said telescopic rod assembly therein, and e. sealing off said well to permanently stop said uncontrolled fountain by pumping cement through an annular space formed between said riser tube and said telescopic rod assembly and into an annular space formed between said well and said telescopic rod assembly.

2. The method as in claim 1, wherein the last flow-restricting rod is selected to have a diameter even or less than the inner diameter of said well.

3. The method as in claim 2, wherein said diameter of the last flow-restricting rod is selected to be about 5-10% less than the inner diameter of said well.

4. A method for killing of an uncontrolled fountain from an offshore oil well comprising the steps of:

a. providing a flow-restricting telescopic rod assembly comprising individual flow-restricting rods of increasing diameters with a first lower rod being the smallest in diameter and suspending thereof on a weight balance located on a sea surface, b. lowering the first flow-restricting rod of said plurality into said well so as to reduce a cross-sectional area of said well leading to a reduction of fluid discharge in said uncontrolled fountain, c. selecting additional rods such that the total weight of the telescopic rod assembly always exceed the forces pushing thereof out of the well by at least 100 kg as monitored by said weight balance;

d. serially attaching additional rods to said first rod and lowering the telescopic rod assembly into said well, whereby further reducing the cross-sectional area of said well causing a further reduction of fluid discharge in said uncontrolled fountain, and e. sealing off said well to permanently stop said uncontrolled fountain.

* * * * *